US005802653A

United States Patent [19]

Roumagnac

[11] Patent Number: 5,802,653

[45] Date of Patent: Sep. 8, 1998

[54] DEVICE FOR AUTOMATICALLY CLEANING THE BOTTOM AND WALLS OF A SWIMMING-POOL

[76] Inventor: Max Roumagnac, 7 rue Hector Berlioz, F-33127 Martignas sur Jalles, France

[21] Appl. No.: 643,571

[22] Filed: May 6, 1996

[30] Foreign Application Priority Data

May 4, 1995 [FR] France ..... 95 05540

[51] Int. Cl.[6] ..... E04H 4/16

[52] U.S. Cl. ..... 15/1.7; 15/409

[58] Field of Search ..... 15/409, 1.7

[56] References Cited

U.S. PATENT DOCUMENTS

| | | | |
|---|---|---|---|
| 2,725,356 | 11/1955 | Lombardi | 15/1.7 |
| 4,589,986 | 5/1986 | Greskovics | 15/1.7 |
| 5,033,148 | 7/1991 | Chauvier | 15/1.7 |
| 5,099,535 | 3/1992 | Chauvier | 15/1.7 |

FOREIGN PATENT DOCUMENTS

| | | | |
|---|---|---|---|
| 505 876 | 12/1977 | Australia . | |
| 862957 | 2/1971 | Canada | 15/1.7 |
| 2 238 808 | 2/1975 | France . | |
| 2 520 420 | 7/1983 | France . | |
| 2 201 758 | 7/1972 | Germany . | |
| 0891496 | 12/1981 | U.S.S.R. | 15/1.7 |
| WO 87/00883 | 2/1987 | WIPO . | |

*Primary Examiner*—Randall E. Chin
*Attorney, Agent, or Firm*—Young & Thompson

[57] ABSTRACT

A device for automatically cleaning the bottom and walls of a swimming-pool includes a suction/discharge body (11) having an orifice or suction opening (12) and a discharge orifice (13), an ejector comprising a driving nozzle (14) and a venturi diffuser (15) and a moveable device (17) for collecting debris. The ejector is disposed inside the body (11) and the nozzle (14) is able to be connected to a discharge opening (5) of the swimming-pool via a conduit with one portion being formed by an accordion wall flexible pipe (10). The device further comprises a propulsion device which creates between the discharge opening (5) and the nozzle (14) a transient and repeated escapement of the pressurized water of the conduit externally so as to create a movement of the device by repeated elastic expansion/constriction of the flexible pipe (10).

19 Claims, 6 Drawing Sheets

DEVICE FOR AUTOMATICALLY CLEANING THE BOTTOM AND WALLS OF A SWIMMING-POOL

FIELD OF THE INVENTION

The present invention concerns the cleaning of swimming-pools, basins, spas or similar installations. In particular, the invention concerns a device for automatically cleaning the bottom and walls of a swimming-pool.

BACKGROUND OF THE INVENTION

So as to preserve clear water, it is essential to clean the swimming-pool regularly. To achieve this, several types of devices exist and can be basically classed into four categories:

The devices integrated in the swimming-pool structure:

These consist of placing in suspension the various types of debris so that the latter are then sucked up by the swimming-pool filtering devices. These devices are automatic and efficient but relatively expensive and need to be provided when the swimming-pool is erected;

the autonomous devices or robots:

These are small autonomous units which move at the bottom and onto the walls of the swimming-pool on filtering water. These units, moved electrically, are autonomous and independent of the filtering device of the swimming-pool, but are relatively expensive and less reliable owing to their complexity.

the suction devices controlled by the filtering device of the swimming-pool, such as the one shown diagrammatically in FIG. 1. The suction circuit of the swimming-pool P includes a bottom drain or bunghole 1, suction chutes and surface skimming chutes or skimmers 2, a pump 3, a filter 4, a discharge opening 5 and a conduit 6 connecting the various elements together, the suction device 7 being connected by an accordion wall type flexible pipe 8 to one of the skimmers 2. The bottom bunghole 1 and the skimmers not used need to be sealed off when the suction device 7 is functioning. The suction device 7 moves by jerks, either by means of a turbine which drives wheels or runners, or by means of the periodic elastic expansion/constriction phenomenon of said pipe, these jerks being provoked by a device for cyclically interrupting the flow of water sucked up which creates a strong partial vacuum.

The design of these suction devices is simple and inexpensive. However, they do have a considerable number of drawbacks.

As the bunghole and the skimmers not involved in the suction operation need to be sealed off, the recycling of water carried out by the latter on the surface and at the bottom of the swimming-pool is suppressed and significantly reduced during the use of the suction device.

It is necessary to start suction by filling the entire circuit with water. Consequently, it is necessary to monitor the functioning of the suction device so as to check that it is not de-watered, which may occur when it moves.

The debris are driven into the pre-filter of the skimmer used and part of them into the pump 3 and the filter 4. Thus, the pre-filters and filters become dirty and risk to become clogged up. This may cause cavitation and dewatering of the pump. These suction devices are therefore not practical or simple to use.

Finally, for those devices which move on account of interrupting suction, the jerks cyclically provoked in the pipe connecting the suction device to the skimmer are transmitted to the entire installation and risk eventually damaging the pump of the suction circuit.

The final category of cleaning devices is constituted by devices operating by discharge according to the principle of the ejector, such as the one described in the document FR-2-586 054 filed in the name of the Applicant.

The device described in this document comprises a housing fitted with a suction opening situated near the surface to be cleaned. This device is suitably ballasted so that when it moves, the suction opening remains nearest the surface to be cleaned. All the water forced back by the discharge orifice of the swimming-pool is available for functioning of the ejector, the jet ensuring both suction of the debris and the movement of the device in the swimming-pool. Its design is simple and inexpensive and is able to resolve the drawbacks of suction devices which function on suction.

However, this device does have several drawbacks. In fact, its ballast enables it to solely move on the bottom of the swimming-pool or on slightly slanted walls. For example, it is unable to clean vertical walls. Furthermore, it has a rather small debris collecting and storage capacity.

There are other devices which function by discharge. But their movement is obtained by devices (especially turbines or pressurized water jets) which constantly take one portion of the water supplied to the nozzle of the ejector, which significantly reduces the efficiency of the device. This is why certain of these devices need to be connected to a supercharger so as to be able to function.

These devices are also ballasted and cannot move on approximately vertical walls. They are more complex that the device mentioned in the document FR-2-586 054 and are less reliable and more costly than said device.

SUMMARY OF THE INVENTION

The present invention is able to resolve the drawbacks of the devices described above by offering a reliable device of simple design functioning by discharge and able to clean the bottom and approximately vertical walls of the swimming-pool, the device not requiring any continuous taking of the water provided by the ejector in order to move and be able to function automatically by being solely connected to one discharge opening of the swimming-pool.

To this effect, the invention concerns a device for automatically cleaning a swimming-pool and including:

a suction/discharge body having an orifice or suction opening disposed in a plane approximately parallel to the surface to be cleaned a short distance from said surface, and a discharge orifice;

an ejector comprising a driving nozzle able to be connected to a source of pressurized water, and a venturi diffuser;

a movable debris collecting device, wherein said ejector is disposed in the body and the nozzle is able to be connected to a discharge opening of the swimming-pool by a conduit having one portion being formed by an accordion wall type flexible pipe, and wherein it comprises a propulsion device constituted by a device so as to create between said discharge opening and said nozzle a temporary and repeated escapement outwardly of the pressurized water of said conduit so as to create a movement of the device via the repeated elastic expansion/constriction of the flexible pipe.

BRIEF DESCRIPTION OF THE DRAWINGS

Other characteristics and advantages of the invention shall appear more readily from a reading of the following description of a preferred embodiment, the description being given solely by way of example, with reference to the accompanying drawings in which.

DETAILED DESCRIPTION OF THE PREFERRED EMBODIMENTS

Figure 1:
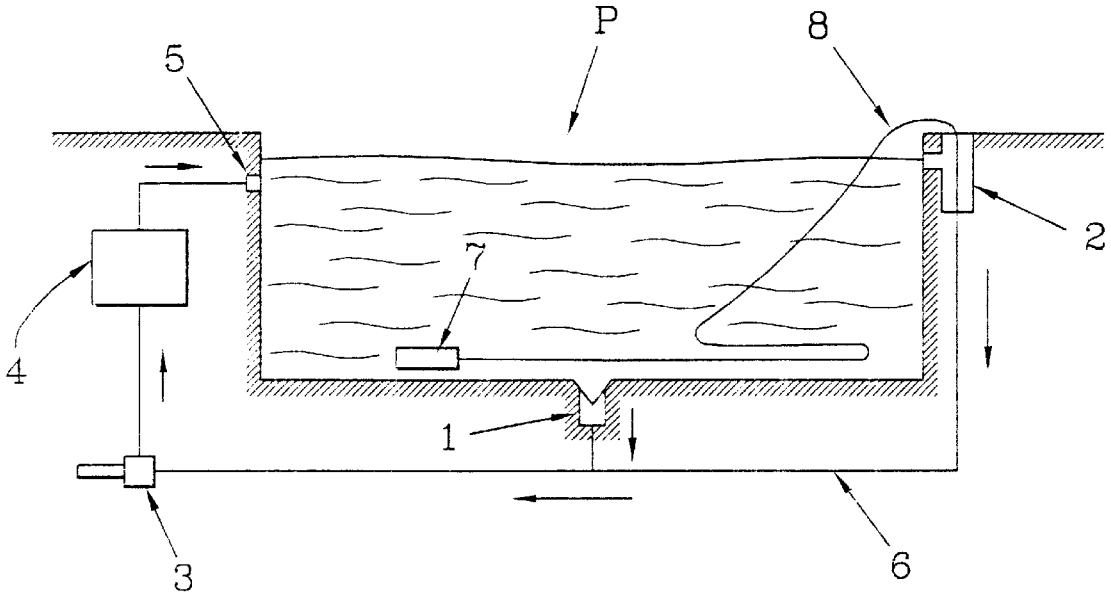
FIG.1 PRIOR ART
FIG. 1 is a diagrammatic front cutaway view of a swimming-pool equipped with a cleaning device of the prior art and functioning on suction.

FIG. 1 has been described in the foreword of the description with reference to the prior art.

Figure 2:
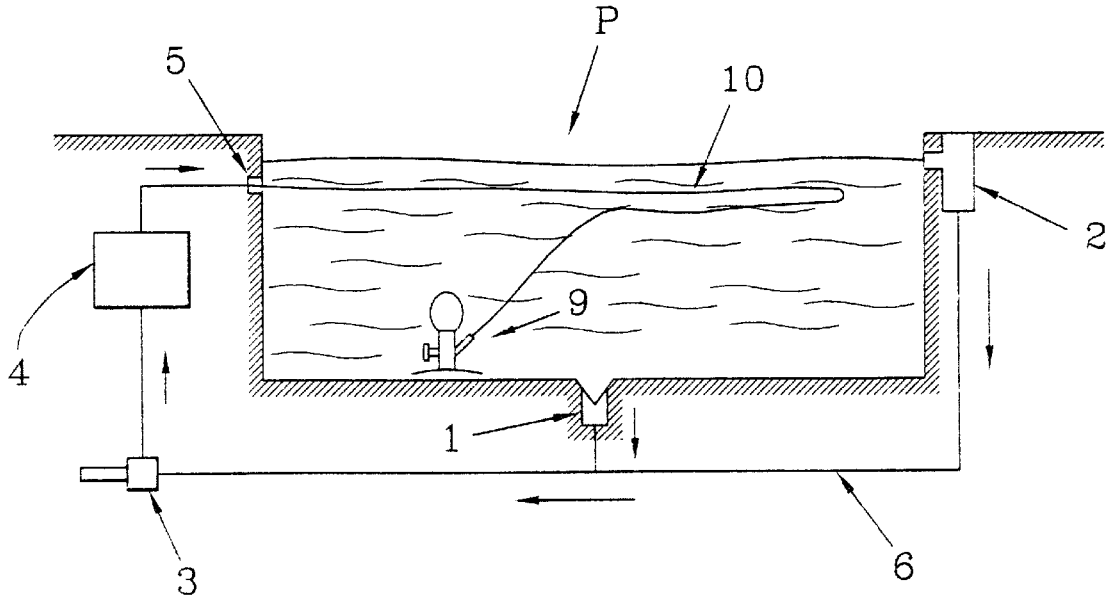
FIG. 2 represents the swimming-pool of FIG. 1 with a cleaning device according to the present invention.

FIG. 2 represents the same swimming-pool P equipped with the cleaning device 9 of the invention. The elements common to FIGS. 1 and 2 bear on FIG. 2 the same references as on FIG. 1.

Contrary to the suction device 7 of the prior art which is connected to the skimmer 2, the device 9 of the invention is connected to the discharge opening 5 by a known type of accordion wall flexible pipe 10. The pipe 10 is long, namely at least longer than the largest dimension of the swimming-pool.

Figure 3:
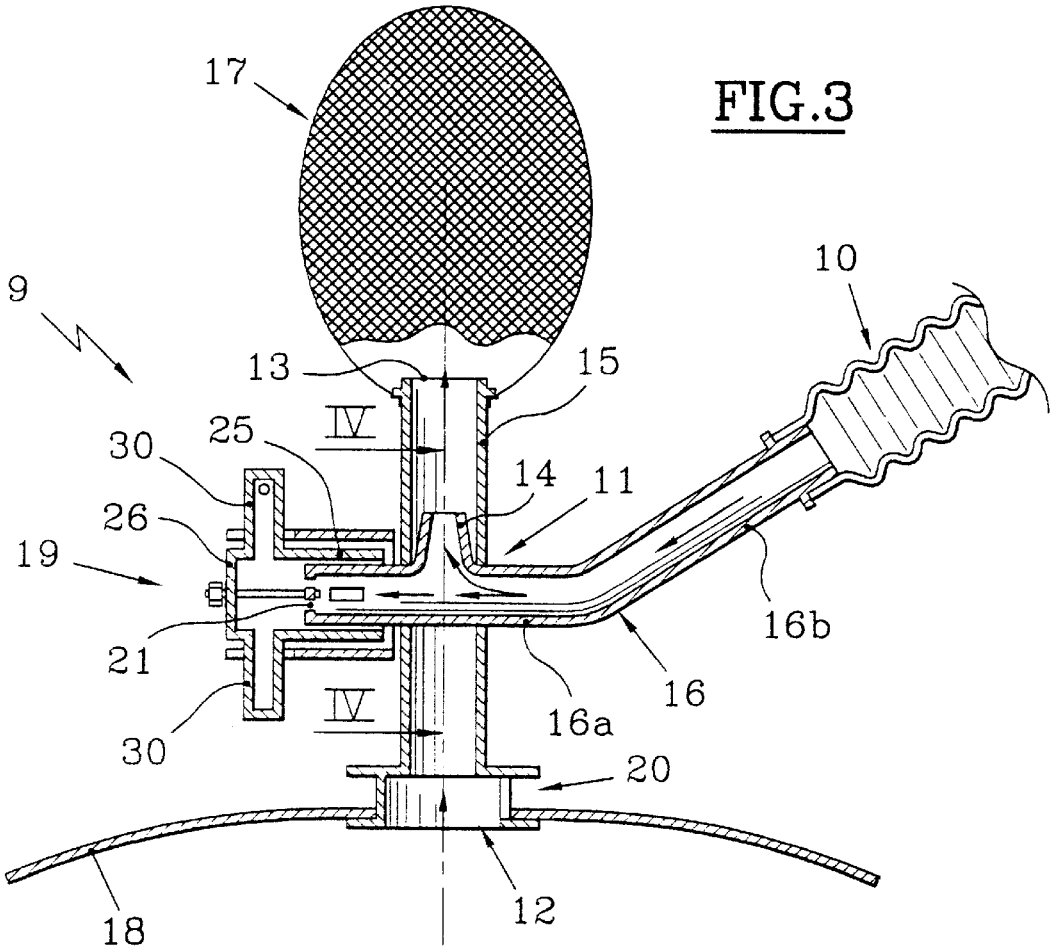
FIG. 3 is a vertical cutaway view of a preferred embodiment of the device of the invention.
Figure 4:
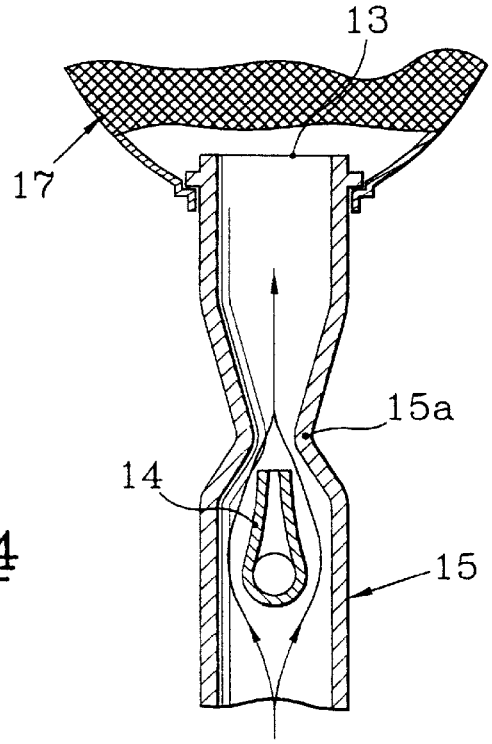
FIG. 4 is a partial cutaway view along the line IV—IV of the device of FIG. 3.
Figure 5:
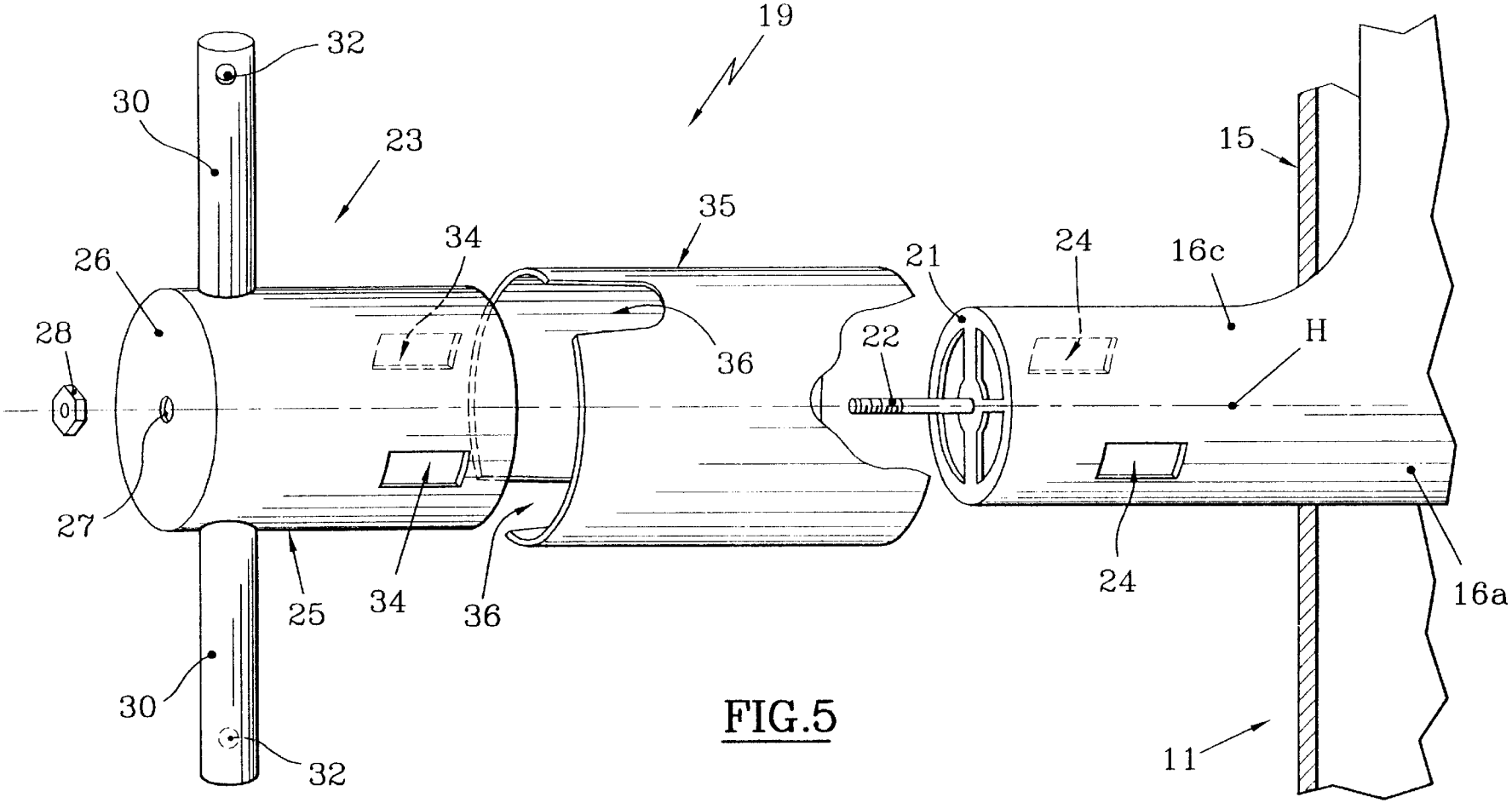
FIG. 5 is an exploded view of a portion of the device of FIG. 3.

The device 9 is shown in detail in FIGS. 3 to 5. It includes a suction/discharge body 11 having an orifice or suction opening 12 and a discharge orifice 13, an ejector disposed in said body 11 and comprising a driving nozzle 14 and a venturi diffuser 15, a rigid conduit 16 for feeding the nozzle 14 with water under pressure, a debris receptacle 17, a flange or flexible skirt 18 and a cyclic discharge valve 19.

Figure 7:
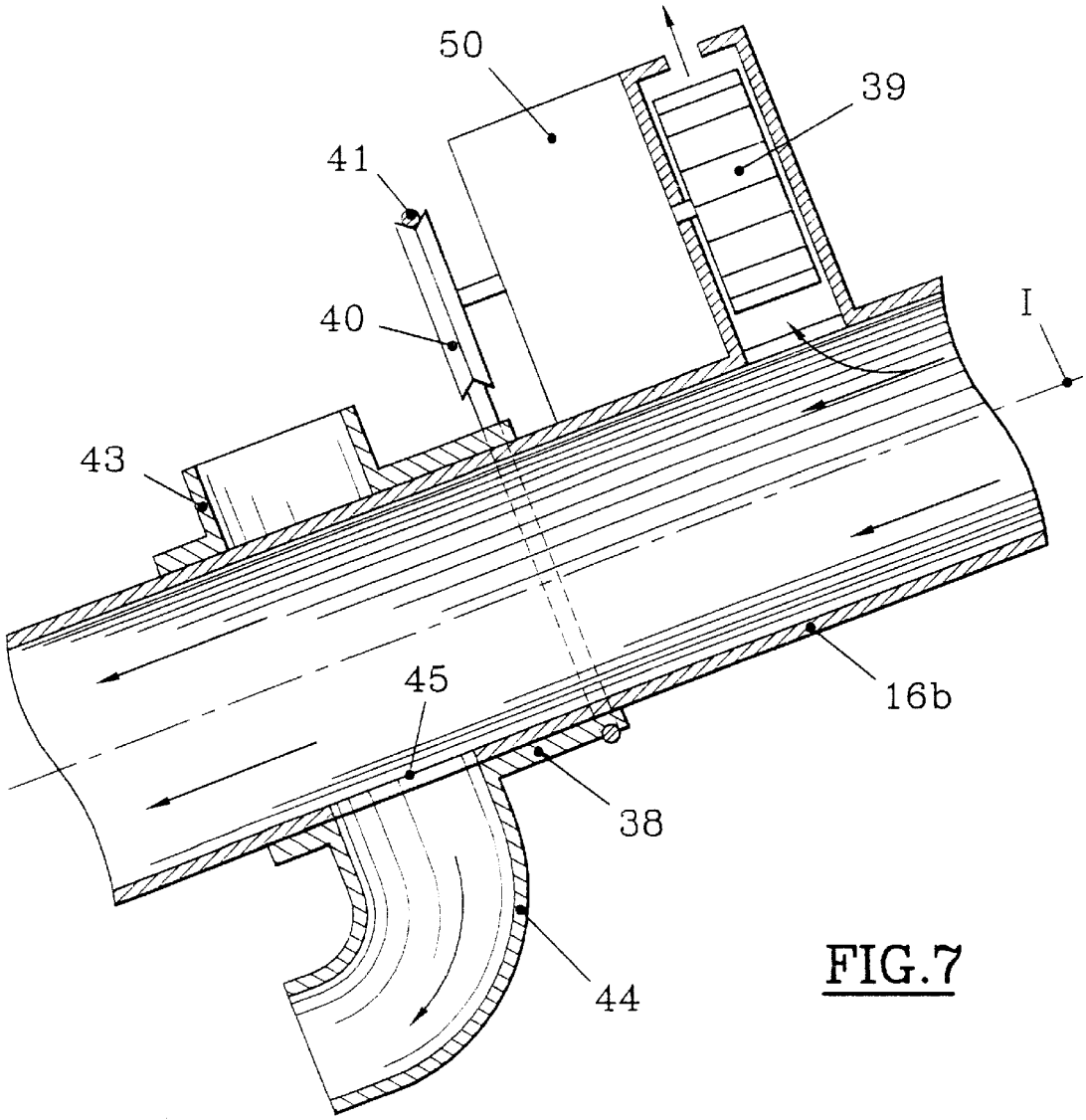
FIG. 7 is a cutaway view of a second variant of the device of FIG. 3.

In the embodiment represented, the body 11 is formed by a cylindrical conduit with a vertical axis whose wall is locally deformed so as to constitute the diffuser 15. The lower extremity of the cylindrical conduit forms the suction opening 12 close to which the flange 18 is disposed. The upper extremity of said conduit forms the discharge orifice 13, in line herewith the debris receptacle 17 is mounted. A small lateral suction window 20 is fitted on the body 11 at the level of the flange 18. The conduit 16 is elbowed and includes a portion 16*a* with a horizontal axis H perpendicular to the axis of the body 11 and penetrating into the latter, and a portion 16*b* with a slanted axis I (FIG. 7).

The flexible pipe 10 is connected by any suitable means to the conduit 16*b*.

The nozzle 14 is disposed vertically coaxial to the body 11 and laterally to the feed conduit 16*a* and defines a horizontal adjutage. The section of the nozzle 14 gradually narrows from the conduit 16*a* up to the adjutage which defines a narrow outlet generating a water jet with a vertical axis.

The cross-section of the conduit 16 may be about half that of the body 11.

Furthermore, the conduit 16 is extended outside the body 11 opposite the portion 16*b* by a portion 16*c* fitted with said cyclic discharge valve 19.

The diffuser 15 has a neck 15*a* situated approximately at the level of the delivery tube of the nozzle 14.

The debris receptacle 17 is movable and has a perforated structure. It acts as a filter allowing the water originating from the outlet orifice 13 to pass whilst retaining the propelled debris.

An exploded view on FIG. 5 shows the cyclic discharge valve 19.

The extension 16*c* of the conduit 16 is cylindrical and comprises an added circular bottom 21 whose centre is fitted with a spindle 22 bearing a turbine 23.

Close to the added bottom 21, the conduit 16*c* comprises two symmetrical elongated holes 24.

The turbine 23 is formed by a cylindrical sleeve known as an internal sleeve 25 which covers the extension 16*c*. The internal diameter of the sleeve 25 is slightly larger than the outer diameter of the conduit 16*c*.

This internal sleeve 25 comprises a circular bottom 26 provided with a hole 27 for passage of the spindle 22. A nut 28 ensures the mounting of the internal sleeve 25 on the spindle 22. Suitable means (not shown) are provided so that the internal sleeve 25 rotates freely around the spindle 22.

Close to its bottom 26, the sleeve 25 comprises two radial conduits 30 each provided at their extremity with a hole 32 for driving the sleeve 25 in rotation by means of reaction.

The internal sleeve 25 is mounted so that the radial conduits 30 are situated between the bottom 26 of the internal sleeve 25 and the open bottom 21 of the conduit 16*c* (FIG. 3).

The internal sleeve 25 comprises two symmetrical elongated holes 34 disposed so as to be opposite the elongated holes 24 of the conduit 16*c* when the sleeve 25 is rotating.

The outer sleeve 35 covers part of the internal sleeve 25 so as to form a deflector whose role shall be specified subsequently.

The sleeve 35 comprises two diametrically opposing scallopings 36 receiving the radial conduits 30 which thus ensure the driving in rotation of the sleeve 35 (FIG. 3).

The cleaning device 9 of the invention functions as follows.

One extremity of the flexible pipe 10 is connected to the conduit 16*b*. The device 9 is disposed on the bottom of the swimming-pool P and then the other extremity of the pipe 10 is connected to a discharge opening 5 of the swimming-pool P.

The pipe 10 is significantly stretched under the pressure of the water engaged in said pipe.

The major part of the water driven back into the pipe 10 is expelled through the adjutage of the nozzle 14, the jet under pressure creating suction which drives the water of the body 11 into the debris receptacle 17. The water sucked up by the opening 12 drags along the debris located nearby. The purpose of the suction of the water at the level of the opening 12 is to create a depression under the flange 18 and place the device 9 against the surface to be cleaned.

One small portion of the water driven back into the pipe 10 traverses the open bottom 21 of the conduit 16*c* so as to be ejected through the holes 32 of the radial conduits 30. On reaction, the sleeves 25 and 35 start to rotate.

When the sleeves 25 and 35 are rotating, the elongated holes 34 on each half-turn coincide with the elongated holes 24 of the conduit 16*c*. This has the effect of abruptly strongly reducing the pressure existing in the conduit 16 and in the pipe 10 since the water suddenly escapes outside the conduit 16 through the elongated holes 24. After this abrupt pressure reduction, the pipe 10 contracts. At the time of this constriction, the pipe 10 pulls the conduit 16 towards it which moves the device. This movement of the device via the repeated constriction-elastic expansion of the pipe 10 is well-known and already used for cleaning devices functioning on suction.

It is to be noted that the sudden reduction of pressure in the conduit 16 and the pipe 10 has the effect of reducing the pressure of the jet of the nozzle 14 and thus reducing suction by the opening 12. Accordingly, the depression, which makes it possible to obtain the placing of the device 9 against the surface to be cleaned, is reduced, which favours the movement of the device 9.

The difference between the outer diameter of the sleeve 25 and the internal diameter of the sleeve 35 is such that the water originating from the elongated holes 24, 34 can be evacuated quickly between these two sleeves in a direction which does not disturb the movement of the device 9.

The difference between the outer diameter of the conduit 16*c* and the internal diameter of the sleeve 25 is such that the water leaks between these two elements are minimal.

The ejection of water through the elongated holes 24 does not stop the sleeve 25 from rotating so that the constriction-elastic expansion phenomenon of the pipe 10 is reproduced on each coincidence between the elongated holes 24, 34.

It is to be noted that the depression created close to the suction opening 12 and the flange 18 ensures that the device is placed properly at the bottom of the swimming-pool and indeed on its approximately vertical walls.

The device described is inexpensive and can be adapted to all types of swimming-pools. It limits disturbances as regards the functioning of the skimmers 2 and the bottom bunghole 1 which still continue to operate during use of the device.

As the device 9 functions on discharge, the jerks provoked do not damage the pump 3.

It is strictly not essential to start the functioning of the device 9 or even monitor it whilst functioning.

The debris receptacle 17 does not increase soiling of the pre-filters and filters 4 of the suction circuit of the swimming-pool, thus reducing during movement the risks of cavitation of the pump 3.

The device 9 described above allows for a large number of variants, such as those shown on FIGS. 6 to 9.

Figure 6:
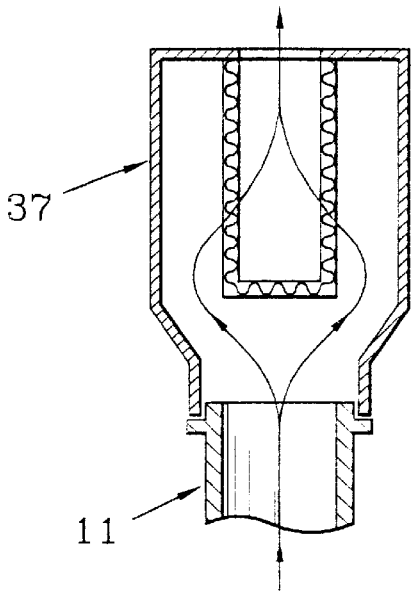
FIG. 6 is a partial cutaway view of a first variant of the device of FIG. 3.

FIG. 6 shows a variant in which the debris receptacle 17 is replaced by a movable filtering cartridge 37 with an opaque wall. This cartridge renders the device more aesthetic since the debris remain inside the cartridge.

As shown on FIG. 7, the conduit 16*b* has been fitted with an outer sleeve 38 driven in rotation by a turbine 39 fed by a portion of the water circulating in the conduit 16*b*. This turbine drives the sleeve 38 by a pinion 40 and belt 41 system. A speed reducer 42 is disposed between the turbine 39 and the pinion 40.

The sleeve 38 comprises an escapement conduit 43 with an axis perpendicular to the axis I and an escapement conduit 44 bent in the direction of the device 9.

The rotation of the sleeve 38 around the conduit 16*b* enables the escapement conduits 43 and 44 to communicate alternatively with said conduit 16*b* via an orifice 45.

The role of the escapement conduits 43, 44 is to generate a lateral offsetting of the conduit 16*b* with a component force parallel to the axis I whose effects are added to those of constriction and elastic expansion of the pipe 10.

The device described with reference to FIG. 7 can replace or complete the discharge valve 19.

Figure 8:
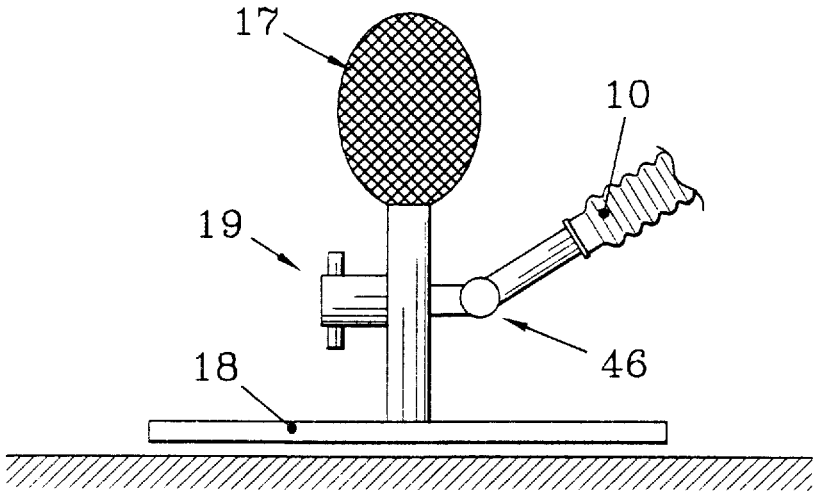
FIG. 8 is a diagrammatic view of a third variant of the device of FIG. 3.

FIG. 8 diagrammatically represents a variant of the device of the invention in which the elbowed portion of the conduit 16 is articulated at 46 around an axis approximately perpendicular to the plane defined by the axis of the body 11 and the axis H of the conduit 16*a*. This facilitates the movement of the device from the bottom to the walls of the swimming-pool.

Figure 9:
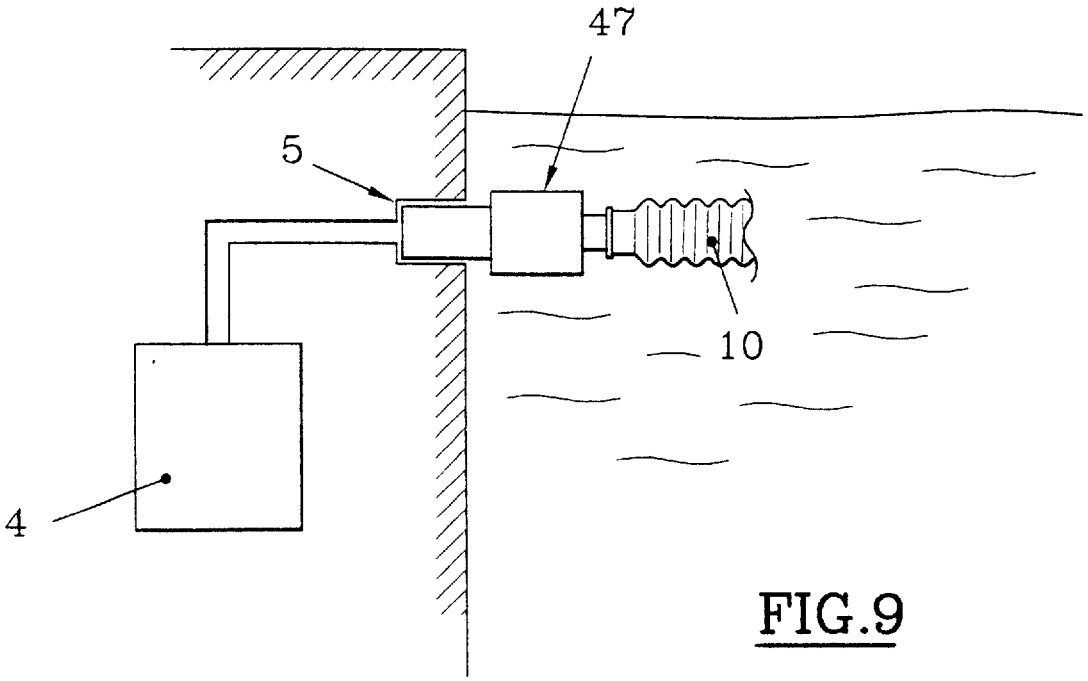
FIG. 9 diagrammatically represents a portion of a fourth variant of the device of FIG. 3, and FIGS. 10 and 11 illustrate a perfecting of the device of the invention consisting of fitting it with a device separating it from the wall when it arrives on the water line.

FIG. 9 diagrammatically shows one portion of a fourth variant of the device of the invention in which the cyclic discharge valve is provided, not on an extension of the conduit 16*a* outside the body 11 or on the conduit 16*b*, but on a connection piece of the pipe 10 at the discharge opening 5. The connection piece, similar to the device shown on FIG. 7, is given the reference 47.

It is subsequently possible to suppress the slanted portion 16*b* of the conduit 16 and connect the pipe 10 directly to the portion 16*a*.

Figure 10:
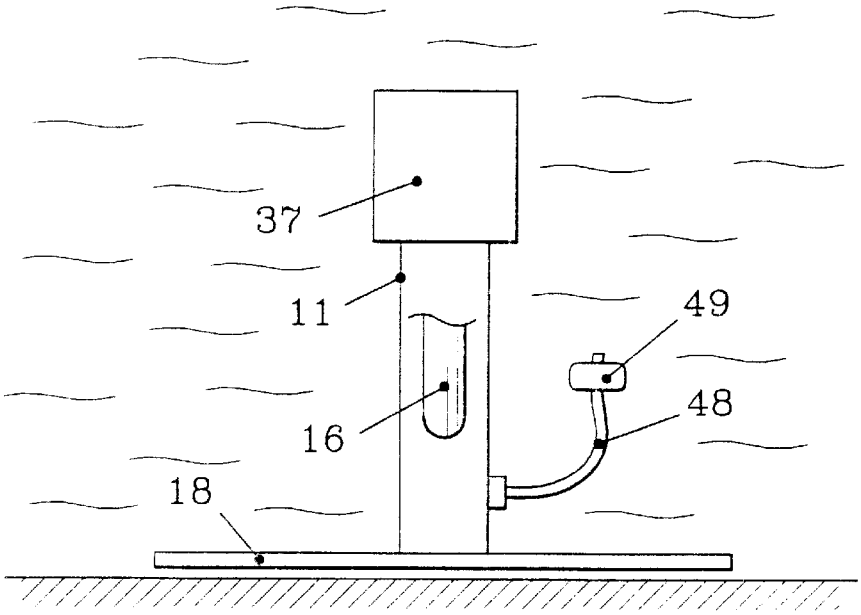
Figure 11:
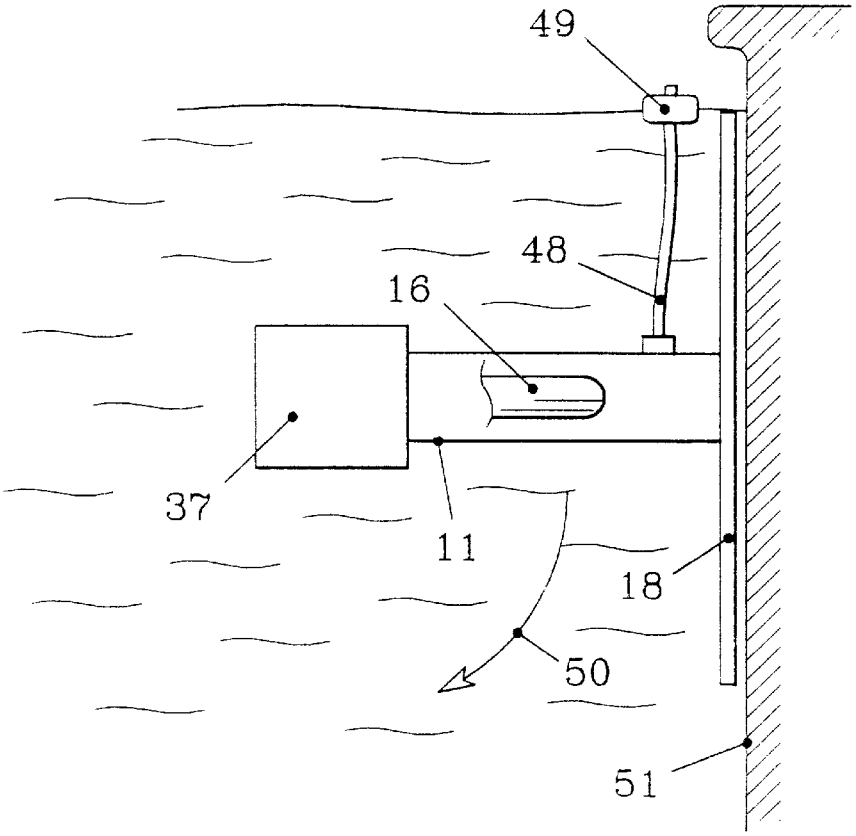

Finally, FIGS. 10 and 11 illustrate a perfecting of the device of the invention and are intended to separate it from the wall of the swimming-pool when it arrives on the water line. To achieve this, the device is fitted with a flexible tube 48 opening into the body 11 preferably, below the venturi diffuser and provided at its free extremity with a float 49.

When the device arrives at the water line (FIG. 11), the tube 48 temporarily makes air penetrate into the body 11 and the filter 37 which causes the device to tilt along the arrow 50.

The device straightens itself by separating automatically from the vertical wall 51 of the swimming-pool and then plunges towards the bottom whilst purging from itself the air which has been introduced by the tube 48.

This device improves the effectiveness of the device of the invention by reducing the time adhering to the walls of the swimming-pool.

Of course, the invention is not merely limited to the embodiments represented and described, but on the contrary covers all possible variants, especially as regards the structure and location at any place whatsoever between the nozzle and the discharge opening 5 of the discharge valve 19. It is to be noted that the discharge opening can be replaced by other devices providing water under pressure, such as a supercharger.

What is claimed is:

1. Device for automatically cleaning the bottom and walls of a swimming-pool, comprising:

a suction/discharge body having a suction opening disposed in a plane approximately parallel to a surface to be cleaned at a short distance from a surface, and a discharge orifice;

an ejector comprising a venturi diffuser, and a driving nozzle adapted to be connected to a source of pressurized water, said driving nozzle being disposed inside the body;

a moveable debris collecting device fluidly connected to said discharge orifice; and wherein in use the nozzle is connected to the source of pressurized water via a conduit having one portion formed by an accordion wall flexible pipe; and propulsion means for creating between the source of pressurized water and said nozzle a transient and repeated outward escapement of pressurized water in the conduit thereby creating a movement of the device by repeated elastic expansion/constriction of the flexible pipe.

2. Device according to claim 1, wherein said conduit comprises another portion formed by a rigid conduit connected to the flexible pipe.

3. Device according to claim 2, wherein the propulsion means is disposed on said rigid conduit.

4. Device according to claim 3, wherein said propulsion means is disposed on an extension of the rigid conduit outside the suction/discharge body.

5. Device according to claim 4, wherein the propulsion means includes a turbine disposed coaxial to said extension of the rigid conduit, said turbine being constituted by a sleeve rotatably mounted on said extension and fitted with at least one radial conduit having at an end thereof an orifice for driving the sleeve in rotation, and at least one elongation hole being disposed in said sleeve so as to come into correspondence with at least one elongation hole disposed in a wall of said extension.

6. Device according to claim 5, wherein the turbine, the suction/discharge body and the ejector each have an axis, and the axis of the turbine is approximately perpendicular to the axis of the suction/discharge body.

7. Device according to claim 3, wherein the propulsion means includes a turbine external to the rigid conduit fed by pressurized water in said conduit, said turbine activating a sleeve encompassing said rigid conduit, said sleeve being fitted with at least one escapement conduit adapted to come into correspondence with an elongated hole fitted in the rigid conduit when said sleeve is rotating.

8. Device according to claim 7, wherein the sleeve comprises two diametrically opposing escapement conduits, the first escapement conduit having a water escapement axis perpendicular to the axis of the rigid conduit, and the second escapement conduit being bent in the direction of the suction/discharge body.

9. Device according to claim 2, wherein the propulsion means is disposed between the discharge orifice and the flexible pipe.

10. Device according the claim 2, wherein the rigid conduit is articulated around an axis approximately perpendicular to a plane defined by an axis of the suction/discharge body and an axis of the rigid conduit.

11. Device according to claim 1, wherein the debris collecting device is mounted incline with the discharge orifice.

12. Device according to claim 1, further comprising a flexible tube having a first end connected to the inside of the suction/discharge body and a second end fitted with a float.

13. Device for automatically cleaning the bottom and walls of a swimming-pool, comprising:

a suction/discharge body having a suction opening disposed in a plane approximately parallel to a surface to be cleaned at a short distance from said surface, and a discharge orifice;

a flexible flange disposed at the suction opening;

an ejector comprising a venturi diffuser, and a driving nozzle adapted to be connected to a source of pressurized water, said driving nozzle being disposed inside the body;

a moveable debris collecting device fluidly connected to said discharge orifice;

wherein in use the nozzle is connected to the source of pressurized water via a conduit having one portion formed by an accordion wall flexible pipe; and propulsion means for creating between the source of pressurized water and said nozzle a transient and repeated outward escapement of pressurized water in the conduit thereby creating a movement of the device by repeated elastic expansion/constriction of the flexible pipe.

14. Device according to claim 13, wherein said conduit comprises another portion formed by a rigid conduit connected to the flexible pipe.

15. Device according to claim 14, wherein the propulsion means is disposed on said rigid conduit.

16. Device according to claim 15, wherein said propulsion means is disposed on an extension of the rigid conduit outside the suction/discharge body.

17. Device according to claim 16, wherein the propulsion means includes a turbine disposed coaxial to said extension of the rigid conduit, said turbine being constituted by a sleeve rotatably mounted on said extension and fitted with at least one radial conduit having at an end thereof an orifice for driving the sleeve in rotation, and at least one elongation hole being disposed in said sleeve so as to come into correspondence with at least one elongation hole disposed in a wall of said extension.

18. Device according to claim 17, wherein the turbine, the suction/discharge body and the ejector each have an axis, and the axis of the turbine is approximately perpendicular to the axis of the suction/discharge body.

19. Device according to claim 13, wherein the debris collecting device is mounted in line with the discharge orifice.

* * * * *